United States Patent [19]

Labelle

[11] Patent Number: 4,573,240

[45] Date of Patent: Mar. 4, 1986

[54] VERTICAL CLOSURE HINGE WITH AN ANTI-BINDING FEATURE

[76] Inventor: Henri M. R. Labelle, 50 Westmooreland Ave., Cornwall, Ont., Canada

[21] Appl. No.: 648,502

[22] Filed: Sep. 10, 1984

Related U.S. Application Data

[63] Continuation of Ser. No. 331,385, Dec. 16, 1981, Pat. No. 4,475,268.

[51] Int. Cl.[4] ..... E05D 1/04

[52] U.S. Cl. ..... 16/355; 16/DIG. 29

[58] Field of Search ..... 16/355, 356, DIG. 29

[56] References Cited

U.S. PATENT DOCUMENTS

| | | | |
|---|---|---|---|
| 2,120,684 | 6/1938 | Soss | 16/356 |
| 2,331,595 | 10/1943 | Bush | 16/355 X |
| 2,567,536 | 9/1951 | Wolters et al. | 16/355 X |
| 2,767,425 | 10/1956 | Bradley | 16/355 X |
| 3,118,702 | 1/1964 | Kale et al. | 16/355 X |
| 3,863,372 | 2/1975 | Stilling | 16/355 X |
| 3,997,939 | 12/1976 | Wilhelmsen | 16/355 X |
| 4,475,268 | 10/1984 | Labelle | 16/355 |

FOREIGN PATENT DOCUMENTS

| | | | |
|---|---|---|---|
| 2411911 | 9/1975 | Fed. Rep. of Germany | 16/355 |

*Primary Examiner*—Fred Silverberg

*Attorney, Agent, or Firm*—Charles E. Brown; Charles A. Brown

[57] ABSTRACT

This invention is directed toward improvements in closure hinges of the type employing curved hinge sections which rotatably interconnect. A rigid link is employed at the ends of the hinge to help retain the hinge sections interconnected. Existing hinge elements are used to connect the links to the hinge. Fasteners means are employed to prevent the hinge sections from moving longitudinally with respect to each other. Spacer elements are provided to prevent the fasteners from binding on the hinge sections.

2 Claims, 11 Drawing Figures

VERTICAL CLOSURE HINGE WITH AN ANTI-BINDING FEATURE

This is a continuation of application Ser. No. 331,385 filed Dec. 16, 1981, now U.S. Pat. No. 4,475,268 issued Oct. 9, 1984.

BACKGROUND OF THE INVENTION

1. Field of the Invention

This invention is directed toward improvements in hinges.

The invention is more particularly directed toward improvements in hinges of the type having two hinge members, each hinge member having curved hinge sections, the curved hinge sections of the two hinge members rotatably interconnected to rotatably connect the hinge members together.

In one embodiment of the invention, an improvement is provided which strengthens the hinge. In another embodiment of the invention, an improvement is provided which minimizes binding of the hinge.

2. Description of the Prior Art

Hinges of the above type are normally used to connect panels together in folding closures. The hinge members are normally extruded from aluminum or other similar material. Normally, the curved hinge sections are strong enough to retain the hinge members in interlocked or interconnected relation. However it has been found that the hinge members can be laterally separated from each other if enough force is applied. The curved hinge sections can straighten out slightly under an applied force allowing the hinge members to move laterally apart. The hinge members can be heat treated to strengthen them and thus minimize the problem. However heat treatment is a relatively expensive solution to the problem.

The known hinge members are longitudinally retained in interconnected position by retaining means at each end of the hinge. The longitudinal retaining means comprise a headed fastener which is connected to a hinge section on one hinge member while the head of the fastener overlaps a hinge section on the other hinge member. To be strong enough the fastener is normally made of steel or other similar material. However in closures where the hinges are vertical, the hard steel head of the bottom fastener wears away the softer aluminum hinge section that it overlaps as the hinge rotates. This wear can lead to the hinge member binding on the fastener to prevent proper operation of the hinge.

SUMMARY OF THE INVENTION

It is therefore, one purpose of the present invention to provide means to strengthen the hinge against lateral separation in an inexpensive manner. It is another purpose of the present invention to provide means to prevent relative longitudinal movement of the interconnected hinge members without interfering with proper operation of the hinge. It is a further purpose of the present invention to provide means which both strengthens the hinge and which helps retain the hinge members interconnected both laterally and longitudinally without interfering with the hinge operation.

In acciordance with the present invention, in one embodiment, link means are provided at the ends of the hinge to connect the hinge members together and to prevent, or at least minimize, their tendency to separate laterally under an applied force. The link means are attached to the hinge with existing fasteners employed in the hinge structure to provide simple, inexpensive strengthening means. In another embodiment of the invention, headed fastener means are provided to prevent longitudinal separation of the interconnected curved hinge sections with means to minimize wear between the fastener means and the hinge sections. In a further embodiment of the present invention the link means are employed with the headed fastener means and the wear minimizing means to strengthen the hinge against both lateral and longitudinal separation.

The invention, in one embodiment, is particularly directed toward a hinge for rotatably joining together a pair of panels in a folding closure. The hinge has a first hinge member with means for connecting it to a first panel and with curved hinge sections, and a second hinge member with means for connecting it to a second panel and with curved hinge sections. The curved hinge sections on the first and second hinge members rotatably interconnect to rotatably connect the hinge members together. Rigid link means are provided at the ends of the hinge members to prevent the hinge members from laterally separating.

The invention, in a second embodiment, is particularly directed toward a hinge for rotatably joining together a pair of panels in a folding closure. The hinge has a first hinge member with means for connecting it to a first panel and with curved hinge sections, and a second hinge member with means for connecting it to a second panel and with curved hinge sections. The curved hinge sections on the first and second hinge members rotatably interconnect to rotatably connect the hinge members together. Headed fasterer means are provided at each end of the hinge for preventing longitudinal separation of the interconnected hinge members. The headed fastener means are fastened to one of the hinge sections of one of the hinge members at the axis of rotation of the interconnected hinge sections and overlie one of the hinge sections on the other hinge member. Means are provided for preventing the headed fastener from contacting the hinge section it overlies.

DESCRIPTION OF THE PREFERRED EMBODIMENTS

Figure 1:
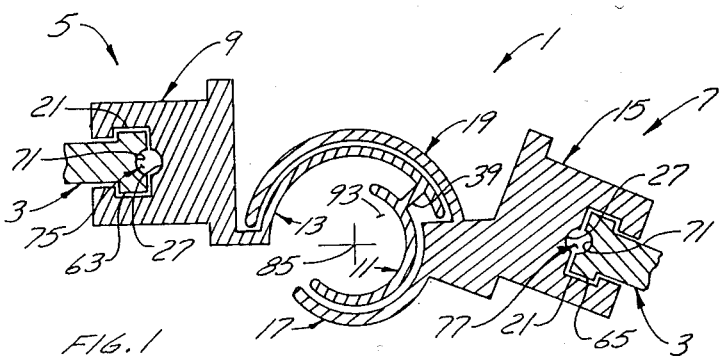
FIG. 1 is a cross-section view of the assembled hinge.

The improved hinge 1 of the present invention, as shown in FIG. 1, is particularly suited for use in pivotally joining adjacent elongated panels 3 together along their adjacent long sides. The panels 3 normally form part of a folding closure. The improved hinge 1 includes two hinge members 5, 7. The first hinge member 5 has an elongated base 9 carrying two curved, elongated hinge sections 11, 13. The second hinge member 7 also has an elongated base 15 carrying two curved, elongated hinge sections 17, 19.

Figure 2:
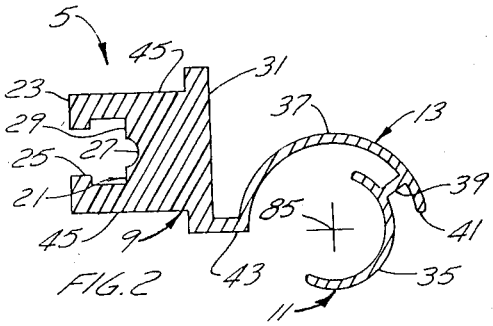
FIG. 2 is a cross-section view of the first hinge member.

In more detail, the elongated base 9 of the first hinge member 5, as shown in FIG. 2, has a generally square cross-sectional shape. A bore 21 extends longitudinally through the base. The bore 21 has a rectangular cross-sectional shape and is located adjacent the inner wall 23 of the base 9. A narrow longitudinal slot 25 in the center of wall 23 provides access to bore 21. A longitudinal groove 27 is provided in the wall 29 of bore 21 opposite slot 25. The groove 27 is adjacent the outer wall 31 of base 9 and has a part-circular cross-sectional shape, which shape is substantially more than half a circle. The base 15 of hinge member 7 is identical to the base 9 as shown in FIG. 3.

The curved hinge section 11 on the first hinge member 5, as shown in FIG. 2, arbitrarily called the first hinge section, comprises a thin strip 35 of material having a part-circular cross-sectional shape which shape is substantially three-quarters of a circle. The curved hinge section 13 on first hinge member 5, arbitrarily called the third hinge section, also comprises a thin strip 37 of material having a part-circular cross-sectional shape which shape is substantially half a circle. The first hinge section 11 has a substantially smaller radius of curvature than the third hinge section 13. The first hinge section 11 is concentrically located within the third hinge section 13 and is joined to the third hinge section 13 by a thin, radially extending web 39 which connects to section 13 near one of its edges 41. Section 13 in turn is connected by its other edge 43 to the outer wall 31 of base 9 adjacent a side wall 45.

Figure 3:
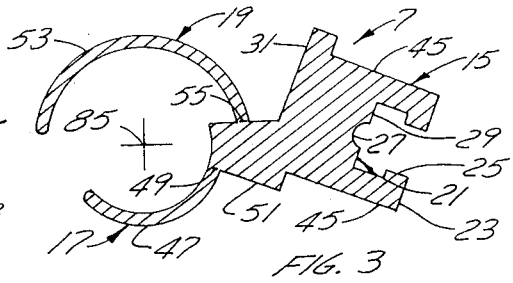
FIG. 3 is a cross-section view of the second hinge member.

The curved hinge section 17 on the second hinge member 7, arbitrarily called the second hinge section, comprises a thin strip 47 of material having a part-circular cross-sectional shape which shape is about one-quarter of a circle as shown in FIG. 3. The strip 47 is attached along one edge 49 by a thin narrow web 51 to the base 15. The web 51 extends generally transversely from outer wall 31 of base 15 adjacent a side wall 45. The curved hinge section 19, arbitrarily called the fourth hinge section, comprises a thin strip 53 of materials having a part-circular, cross-sectional shape which shape is about half a circle. The strip 53 is attached along one edge 55 to the web 51 adjacent base 15 and curves in the opposite direction to second hinge section 17. The second and fourth hinge sections 17, 19 curve toward each other and are concentric to each other with the second hinge section 17 having a smaller radius of curvature than the fourth hinge section 19. The second hinge section 17 has a slightly larger curvature of radius than the first hinge section 11; the third hinge section 13 has a slightly larger radius of curvature than the second hinge section 17; and the fourth hinge section 19 has a slightly larger radius of curvature than the third hinge section 13.

Figure 4:
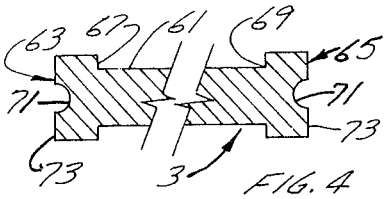
FIG. 4 is a cross-section view of the panel.

The panels 3 can each comprise a narrow long plate 61 as shown in FIG. 4 having a narrow transverse flange 63, 65 along each side edge 67, 69 respectively. Each flange 63, 65 has a central longitudinal groove 71 in its outer side 73. The groove 71 is part-circular in cross-section shape.

Figure 5:
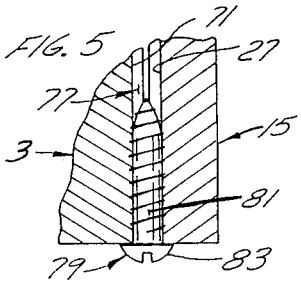
FIG. 5 is a cross-section view of the fastener joining a hinge member to a panel.

The first hinge member 5 is mounted on one side 67 of a panel 3 by sliding it over flange 63 on side 67 as shown in FIG. 1. Flange 3 fits snugly within bore 21 with plate 61 passing through slot 25 and with groove 71 in flange 63 aligned with groove 27 in base 9. Together, the grooves 27 71 form a cylindrical opening 75. The second hinge member 7 is similarly mounted on the side 69 of a second panel 3 by sliding it over flange 65. Flange 65 fits snugly within bore 21 with plate 61 passing through slot 25 in base 15. Groove 71 in flange 65 aligns with groove 27 in base 15 to form a cylindrical opening 77. A fastener 79, as shown in FIG. 5, having a threaded shank 81 and a head 83 is screwed into each end of both openings 75,77. The threads bit into both flanges 63, 65 and bases 9, 15 and the head 83 overlies both the flanges and the bases to retain the hinge members 5, 7 on the panels 3.

The hinge member 5 on one panel 3 is interconnected with the hinge member 7 on an adjacent panel 3 by sliding the hinge sections 11, 13 within the hinge sections 17, 19 as shown in FIG. 1. First section 11 lies within second section 17; second section 17 lies within third section 13; third section 13 in turn lies within fourth section 19. The four sections 11, 17, 13, 19 are concentric within each other permitting the adjacent panels 3 to rotate relative to each other about a longitudinal axis 85. Axis 85 generally defines the center of curvature of the four hinge sections 11, 17, 13, 19.

Figure 6:
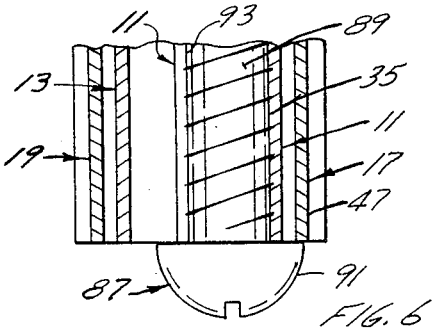
FIG. 6 is a cross-section view of the fastener joining the hinge sections together.

To retain the adjacent panels 3 interconnected longitudinally a fastener 87 having a threaded shank 89 and a head 91 is employed as shown in FIG. 6. The fastener 87 is threaded into the part circular opening 93 defined by first hinge section 11, on hinge member 5, the threads biting into hinge section 11. The head 91 on fastener is large enough to at least overlie the second hinge section 17 on the other hinge member 7. With the hinge members 5, 7 inter connected in this manner, the adjacent panels 3 normally cannot separate.

Figure 7:
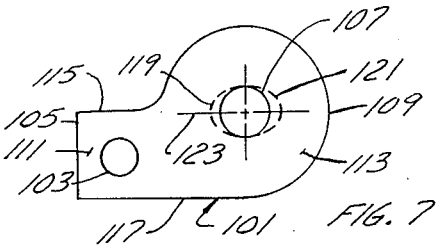
FIG. 7 is a plan view of the link.
Figure 8:
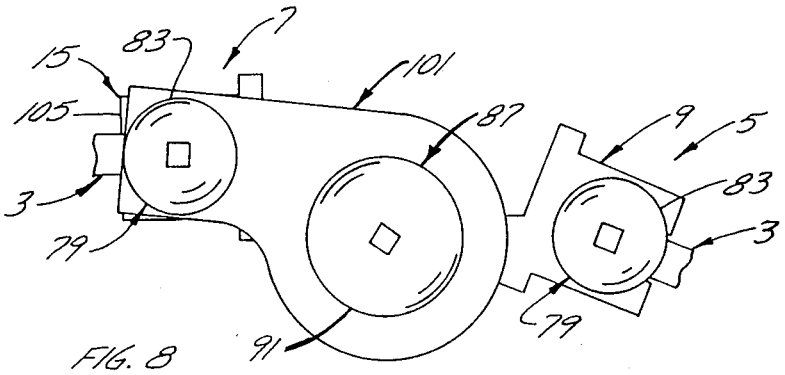
FIG. 8 is a plan view of the link when installed.

The hinge 1 described above is known. In accordance with the present invention, in one embodiment, means are provided for strengthening the hinge 1. The strengthening means comprise means for more securely connecting the interconnected hinge members 5, 7 together to thereby minimize the possibility of the hinge members being pulled or forced transversely apart. The connecting means, as shown in FIGS. 7 and 8 comprises a thin, strong link member 101 adapted to be connected between both hinge members 5, 7 at each end of the hinge 1 without interfering with the hinge action. Preferably, the link member 101 is connected to the hinge members 5, 7 using existing components of the hinge.

In more detail, the link member 101 has a first opening 103 adjacent one end 105 and a second opening 107 adjacent the other end 109. The portion 111 of the link 101 adjacent end 105 is substantially large enough to cover the end of base 15 of hinge member 7. The portion 113 of the link 101 adjacent end 105 is substantially larger than portion 111, the link 101 enlarged from one straight side 115 to form portion 113. The portion 113 is large enough to cover the ends of all the hinge sections, when the hinge members are interconnected, including the outer most hinge section 19. The straight sides 115, 117 of link 101 are generally parallel and also generally parallel to the panel 3 connected to the base 15 when the link is connected to the hinge members. The center of first opening 103 is generally aligned with panel 3 while the center of second opening 107 is offset to one side of panel 3. The first opening 103 is circular and is sized to pass fastener 79 therethrough. The second opening 107 is also circular and is sized to pass fastener 87 therethrough. The link 101 is attached to the end of hinge 1 using fasteners 79 and 87. The link 101 is positioned flat against the end of hinge 1 with opening 103 aligned with opening 77 formed in part by hinge member 7 and with opening 107 aligned with the opening 93 defined by the first hinge section 11 in hinge member 5. Fasteners 79 and 87 are then inserted into openings 77, 93 passing through the openings 103, 107 respectively in link member 101 to connect the link 101 to the hinge 1 and to thus join the hinge members 5, 7 together. It will be seen that no separate means are needed to connect link 101 to hinge 1.

Since the hinge members 5, 7 may not always rotate radially about axis 85, the opening 107 may be slightly enlarged to allow for some transverse play between the hinge members 5, 7 during relative rotation between the members and to thus minimize binding and wear. The opening 107 can be enlarged about its entire periphery or only about opposed portions 119, 121 of its periphery as shown in dotted lines in FIG. 7. These enlarged portions 119, 121 are aligned generally on a line 123 which is generally parallel with the sides 115, 117 of link 101 so as to position them in the area of the greatest amount of transverse play during opening or closing of the hinge. The greatest amount of transverse play occurs just after starting to open the hinge when the least area of second hinge section 17 bears on first hinge section 11, and occurs in a direction generally parallel to panel 3 fastened to base 15.

Figure 9:
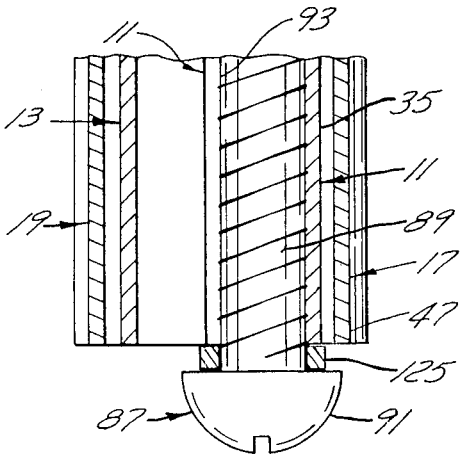
FIG. 9 is a cross-section view of the fastener joining the hinge sections together with a spacer.
Figure 10:
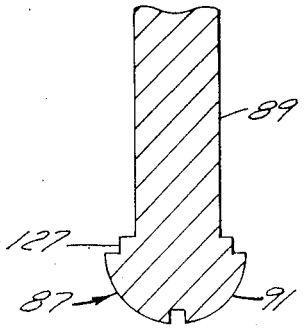
FIG. 10 is a cross-section view of the fastener joining the hinge sections together with a shoulder on the fastener.

In another embodiment of the invention means are provided for minimizing hinge wear. When the head 91 of the fastener 87 abuts against the end of the hinge 1. particularly when the fastener is the bottom fastener in a vertical, hinged closure, the head 91 of the fastener 87 can wear into the hinge section 17 during relative rotation of the hinge members and this would occasionally lead to binding of the hinge. To minimize the problem, means are provided for spacing the head 91 of the fastener 87 away from the hinge section 17. These spacing means can comprise a washer 125 sized to just fit over the first hinge section 11 as shown in FIG. 9. The washer 125 spaces the head 91 away from the next adjacent section 17 which rotates relative to section 11 to which fastener 87 is fastened. Alternatively, as shown in FIG. 10, the fastener 87 can be provided with a shoulder 127 adjacent head 91 sized to fit only on section 11 and to thus space head 91 away from the adjacent section 17.

Figure 11:
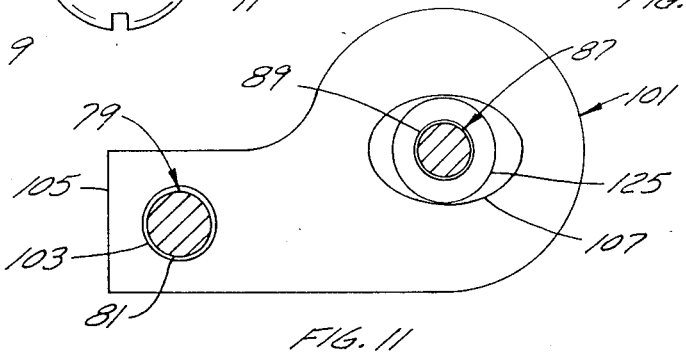
FIG. 11 is a cross-section view showing the link used with a spacer.

When link 101 is employed, the opening 107 is preferably made large enough to comfortably receive either the washer 125 or the shoulder 127 therein without binding as shown in FIG. 11. The washer 125, or the shoulder 127 both have a thickness slightly greater than the thickness of link 101 to prevent the head 91 of fastener 87 from wearing down link 101 during operation of the hinge.

I claim:

1. An assembly for rotatably joining together first and second panels about a vertical axis in a folding closure comprising: a vertical hinge having; a first elongated hinge member having two long sides, means on one of said long sides for connecting said first hinge member to said first panel, first and third curved hinge sections on the other of said long sides; a second elongated hinge member having two elongated sides, means on one of said second hinge member long sides for connecting said second hinge member to said second panel, second and fourth curved hinge sections on the other of said second hinge member long sides; said curved hinge sections on said first and second hinge members being interconnected to rotatably connect said hinge members together with the first hinge section lying within the second hinge section, the second section lying within the third hinge section, and the third hinge section lying within the fourth hinge section; a fastener having a head and a shank at at least the bottom end of said hinge for preventing longitudinal separation of said interconnected hinge members; said fastener being fastened by its said shank to the bottom end of the first curved hinge sections, the said head of the said fastener underlying the bottom end of the fourth hinge section, and spacer means completely encircling and carried by said fastener shank and located between said fastener head and the bottom ends of said curved hinge sections, the spacer means lying within the second hinge section for preventing said fastener head from contacting said bottom end of the second hinge section it underlies; and a link at said bottom end of said hinge for connecting said hinge members together, said fastener connecting said link to one of said hinge members by passing through an opening in one end of the said link, said spacer means positioned in the opening and having a thickness slightly greater than the thickness of said link.

2. An assembly as claimed in claim 1 wherein the spacer means comprises a washer.

* * * * *